United States Patent [19]

Rice et al.

[11] 4,440,096

[45] Apr. 3, 1984

[54] ADJUSTABLE WORD PROCESSING TABLE AND THE LIKE

[75] Inventors: Thomas E. Rice, Cheswick; Peter T. Young, Oakmont, both of Pa.

[73] Assignee: Haskell of Pittsburgh, Inc., Verona, Pa.

[21] Appl. No.: 330,894

[22] Filed: Dec. 15, 1981

[51] Int. Cl.[3] ..... A47F 5/12

[52] U.S. Cl. ..... 108/3; 108/4; 108/5; 108/7; 108/20; 108/147

[58] Field of Search ..... 108/1, 3, 4, 5, 6, 7, 108/8, 9, 10, 96, 102, 147, 143, 20

[56] References Cited

U.S. PATENT DOCUMENTS 2,249,455 7/1941 Caldwell ..... 108/147
4,365,561 12/1982 Tellier et al. ..... 108/7

FOREIGN PATENT DOCUMENTS 53774 7/1964 Belgium ..... 108/7
2301305 7/1973 Fed. Rep. of Germany ..... 108/20
739507 11/1932 France ..... 108/143

*Primary Examiner*—William E. Lyddane
*Assistant Examiner*—Mark W. Binder
*Attorney, Agent, or Firm*—Webb, Burden, Robinson & Webb

[57] ABSTRACT

An adjustable, split top table for accommodating word processing equipment and the like comprises a base support, a main frame connected to the base support and two independently movable table tops (front and rear) adjustably secured to the main frame. A first lead screw is mounted between the main frame and the front table top so as to slope forward at an acute angle to the vertical. A second lead screw is mounted between the main frame and a front section of the rear table top and parallel to the first lead screw. A third lead screw is pivotally mounted between the main frame and a middle section of the rear table top. Drive means are coupled to the lead screws to independently raise and lower the first table top, raise and lower the rear table top and tilt the rear table top.

9 Claims, 12 Drawing Figures

ADJUSTABLE WORD PROCESSING TABLE AND THE LIKE

FIELD OF THE INVENTION

Our invention relates to computer work stations and, more particularly, to split top tables having individually adjustable front and rear planar surfaces for accommodating word processing equipment and the like.

DESCRIPTION OF THE PRIOR ART

With word processing and other computer related systems becoming commonplace in offices and business in general, a new form of work station or furniture for supporting such electronic equipment is evolving. These work stations for the electronic office range from simple support structures to fully ergonomic designs.

Much of this electronic equipment is of the multiple component type, for example, CRT units which include a keyboard and a screen. The keyboard must be maintained at a level compatible with manual input, whereas the screen must be maintained at near eye level for ease of visual observation. Because of the expense of electronic equipment, normally a single unit or a small number of units are provided for an entire office staff. For this reason work stations including adjustable support surfaces are being developed to permit positioning of the various pieces of electronic equipment at alternate height levels to accommodate the wide range of uses and of user sizes which are commonplace in most offices. In addition, it has been recognized that since lighting in most offices is fixed, it is often desirable to have the capability to adjust any visual display to prevent glare.

SUMMARY OF THE INVENTION

Our invention permits independent adjustment of the support structure for separate pieces of electronic equipment such as the keyboard and the screen. We are thus able to provide a single piece of electronic equipment support structure which is readily adjustable to accommodate a wide range of uses as well as users in terms of their size. In a preferred form, our invention may include actual height location information so repeat users may merely approach the table, set the controls and proceed with their work knowing that the height location of both the keyboard and the screen will be correct. All of these advantages accrue on a piece of equipment which is totally functional, easily maintained and producible at a cost within the reach of the average office and business alike.

Our invention is an adjustable, split top table for accommodating word processing equipment and the like comprising a base support for resting on the floor, a main frame connected to the base support and a front and rear table top mounted to the main frame for separate vertical adjustment. A first lead screw is mounted between the main frame and the front table top and is sloped forward at an acute angle to the vertical. A second lead screw is mounted between the main frame and a forward section of the rear table top and in parallel relationship to the first lead screw. A third lead screw is pivotally mounted between the main frame and a central portion of the rear table top. Drive means are provided for driving the first lead screw to raise and lower the front table top, of driving the second lead screw to tilt the rear table top and of driving the second and third lead screw to raise and lower the rear table top. The drive means may be individual electronic motors or may be a manual crank. In a preferred form of the invention utilizing individual electronic motors, a control panel is provided which gives a digital readout of the height location.

DESCRIPTION OF THE PREFERRED EMBODIMENTS

Figure 1:
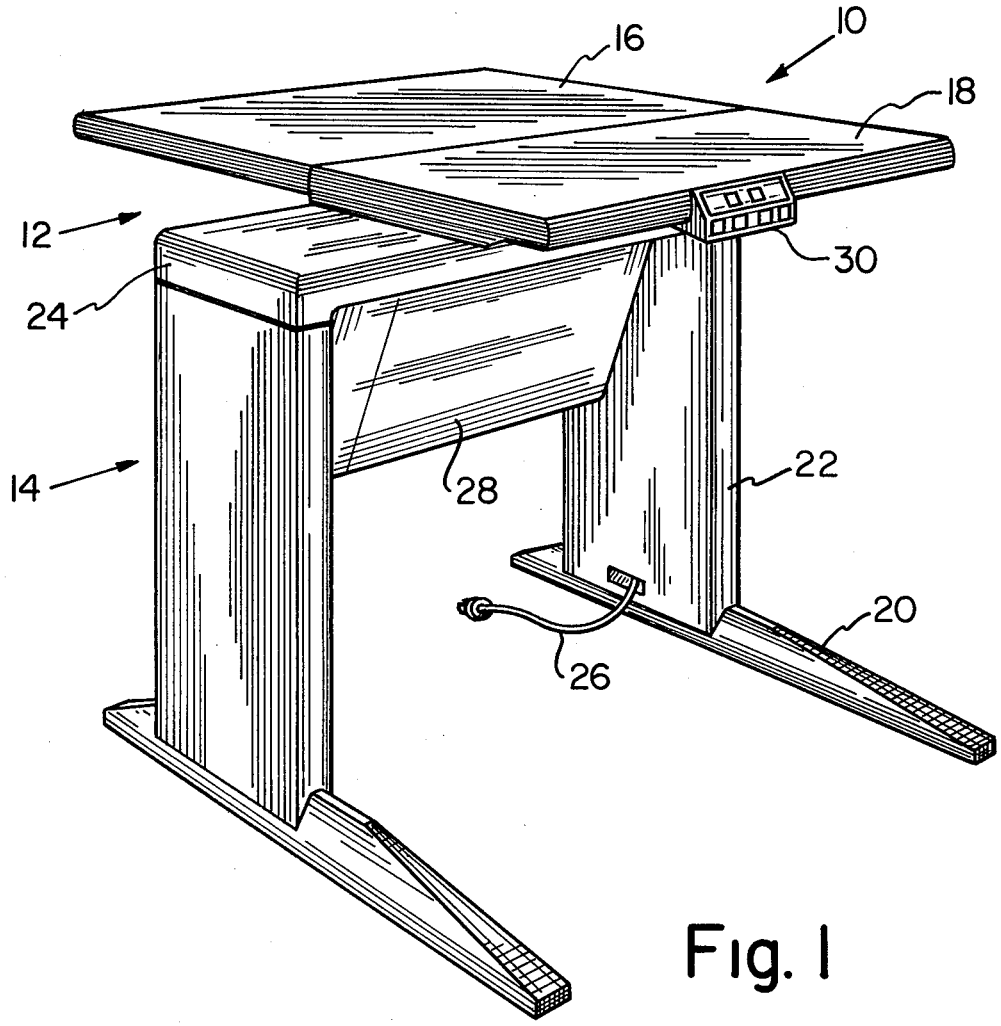
FIG. 1 is a perspective view of the electrically operated form of our adjustable split top table.

The table, generally designated 10, comprises a top 12 and a base 14, FIG. 1. The table top 12 is split so as to include two planar surfaces, namely, rear top 16 and front top 18. The base includes legs 20, side panels 22 extending upward from the legs 20 and a top panel 24 extending between the side panels 22. A front panel 28 extends between the side panels 22 and below the top panel 24 and angles downward away from the front of the table so as to accommodate the knees and legs of a user. A standard cord 26 connects to an outlet (not shown) so as to make the table 10 operational through the control panel 30 positioned along the front portion of front top 18. An appropriate visual shield for the operating mechanism such as a bellows between the table tops 10 and 24 and a safety shield between the split tops 16 and 18 may be utilized but are not shown.

Figure 2:
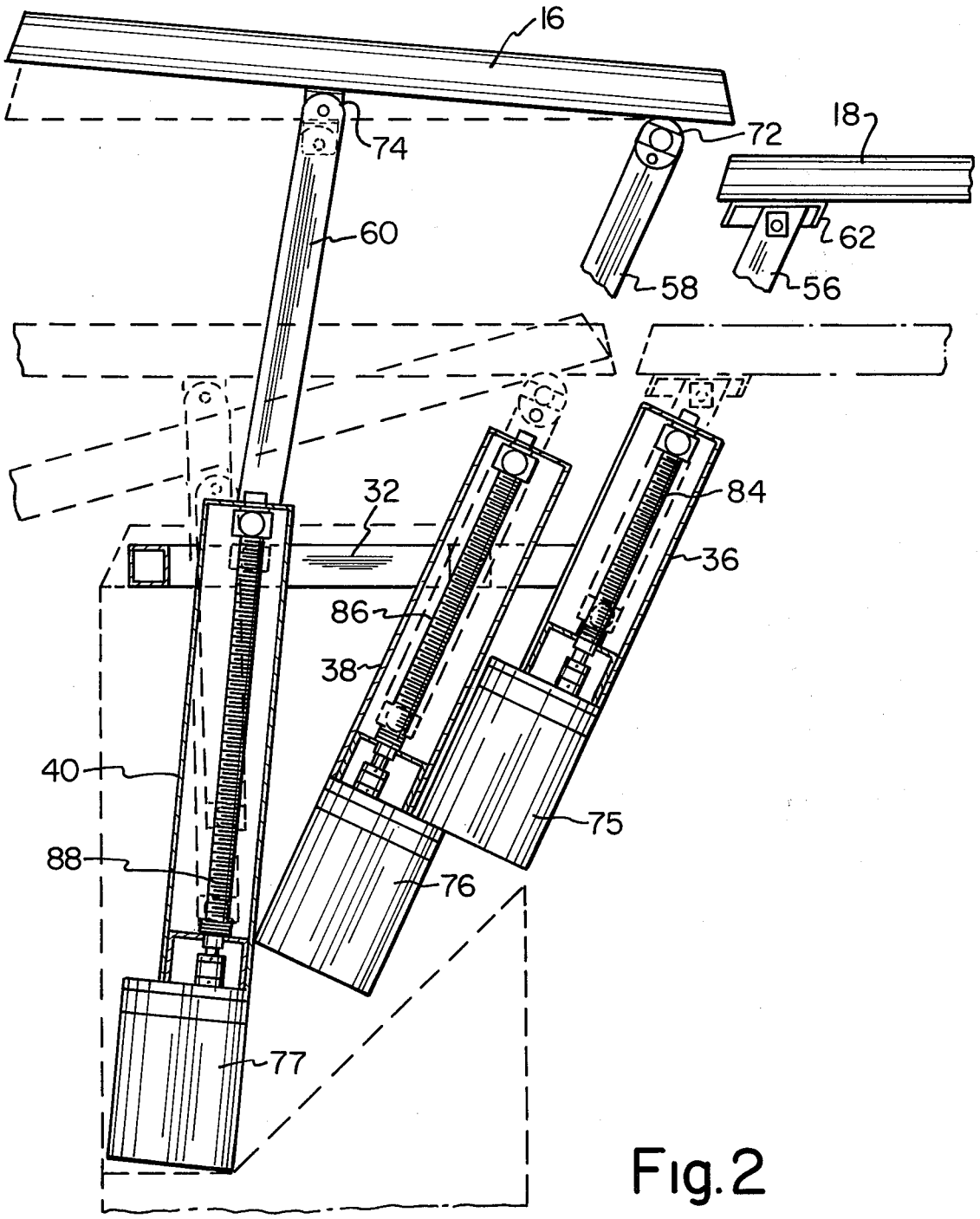
FIG. 2 is a side elevation partly in section showing the operating mechanism of the table of FIG. 1.

The mechanism for vertically adjusting the rear top 16 and front top 18 and tilting the rear top 16 is located rearward of the front panel 28 and is illustrated in FIG. 2. Three individualized adjustment means and drive means are provided for this purpose. Housing 36 containing a lead screw 84 and driven by motor 75 positioned below housing 36 connects to the rear of front table top 18 through bracket 62 and a pair of arms 56 movably mounted to lead screw 84. Lead screw 84 and motor housing 36 are positioned so as to slop forward at an angle on the order of 25° to the vertical. Activation of motor 75 causes front table top 18 to advance upward and forward or downward and rearward between the position shown in dotted lines and the position shown in solid lines.

Motor housing 38 containing lead screw 86 and driven by motor 76 is positioned rearward but parallel to motor housing 36 and connects to the front underside of rear table top 16 through connector 72 which in turn connects to a pair of arms 58 operably connected to the lead screw 86. Arms 58 provide the support for the front portion of rear table top 16. The middle of rear top 16 is supported by a pair of arms 60 connected to the underside of table top 16 by connector 74. Arms 60 are operably connected to lead screw 88 contained within motor housing 40 driven by motor 77. Housing 40 is positioned rearward of housing 38 and is pivotably connected to main frame 32 as will be described hereinafter. To raise or lower rear table top 16 between the position shown in the dotted line and the solid line of FIG. 2, motors 76 and 77 are simultaneously and automatically activated to cause the upward and forward or downward and rearward movement comparable to that of front top 18. To cause tilting of rear top 16 only motor 77 is activated thereby raising or lowering the central portion of rear top 16 while the front portion is pivotably held in place at connector 72.

Figure 3:
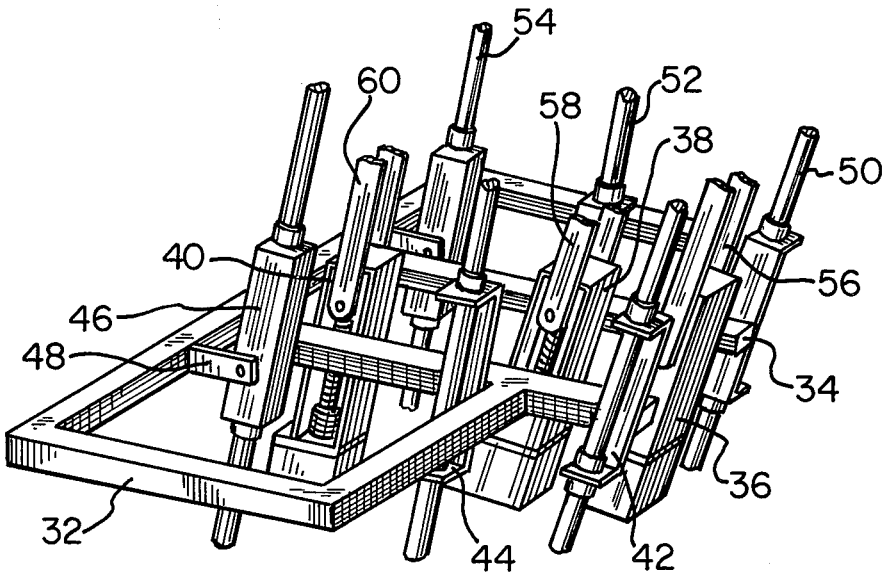
FIG. 3 is a perspective view showing the main frame and the various components connected thereto.

The main frame 32 is substantially rectangular and is formed of square tubing, FIG. 3. A pair of parallel and spaced square tubing members 34 extend forward along either side of the longitudinal central axes of the table. The three motor housings 36, 38 and 40 are mounted in the space formed between and to the parallel members 34. Associated with each motor housing are side brackets which accommodate the legs of support arms which connect to the respective table tops.

Figure 4:
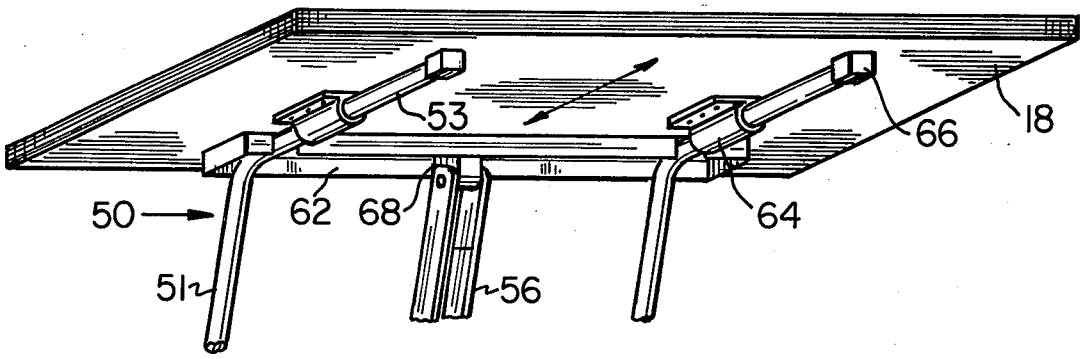
FIG. 4 is a perspective view of the front table top showing the connections thereto.

Specifically, a pair of U-shaped support brackets 42 are connected to the respective members 34 in line with motor housing 36 to accommodate legs 50 which assist in the support for the front top 18, FIGS. 3 and 4. In a similar manner, U-shaped side brackets 44 connect to respective members 34 in alignment with motor housing 58 to house rods 52 which assist in the support for the front of rear top 16, FIGS. 3 and 5. Side brackets 46 which are in alignment with motor housing 40 are pivotally connected to the rear of main frame 32 through a pivotal connection to flanges 48 extending forward from the rear of main frame 32. Brackets 46 house legs 54 which assist in the support for the central area of rear top 16, FIGS. 2, 3 and 5.

The detailed support of front top 18 is shown in FIG. 4. The pair of arms 56 which extend from the lead screw 84 connects to lugs 68 which depend from a main bracket 62 which extends laterally along the bottom surface of top 18 and is secured to top 18 such as by lead screws or the like. Each of the pair of side legs 50 is bent to include a depending section 51 and a horizontal section 53. The horizontal section 53 is mounted within nylon slides 64 which are screwed into the bottom of the table top 18. Stops 66 are positioned at the end of rods 53 so that the table top can be manually moved forward and rearward between the bracket 62 and the forward stop 66.

Figure 5:
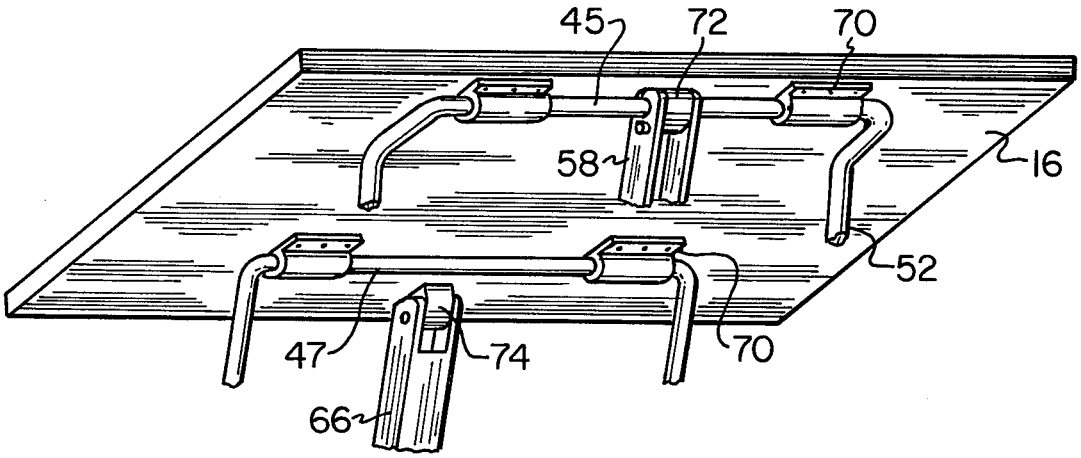
FIG. 5 is a perspective view of the rear table top showing the connections thereto.

The detailed support of the rear table top 16 is illustrated in FIG. 5. The upstanding legs 52 are a continuation of the support rod 45 which is connected to the front portion of table top 16 by a pair of spaced mounting brackets 70. The arms 58 which extend upwardly from the lead screw 86 likewise connect to the support rod 45 by means of a nylon connector 72. The legs 54 are extensions of support rod 47 which is secured to the central portion of table 16 by spaced mounting brackets 70. The arms 60 which are operable through lead screw 88 connect to table 16 rearward of the support rod 47 by means of a pivotal connection to coupling 74.

Figure 7:
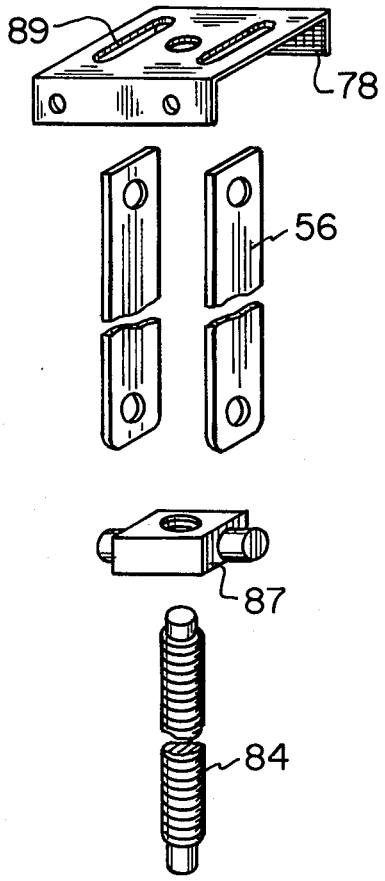
FIG. 7 is an exploded view of certain components of the motor housing of FIG. 6.
Figure 6:
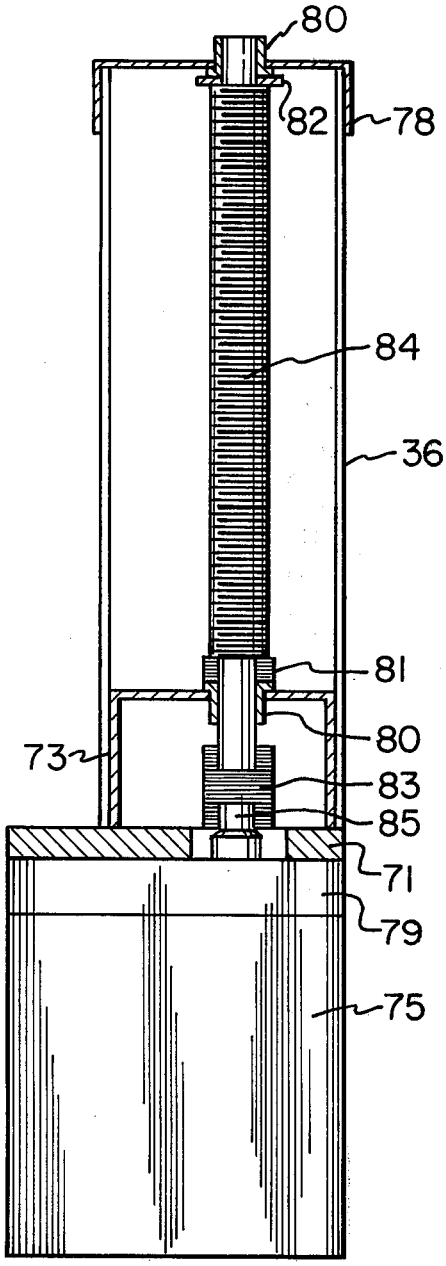
FIG. 6 is a partial section taken through one of the motor housings.

The motor 75, motor housing 36 and certain integral parts are illustrated in FIGS. 6 and 7. It should be noted that the other two motor housings 38 and 40 are similarly constructed. Motor housing 36 is closed off at its upper end by top bracket 78 which includes a pair of slots 89 through which arms 56 extend. The bottom of motor housing 36 is closed off by bottom plate 71. Extending upward within the housing 36 from bottom plate 71 is bottom bracket 73.

A lead screw 84 is supported between top bracket 78 and bottom bracket 73 by means of flange bearing 80 and thrust washer 82 in the area of top bracket 78 and thrust bearing 81 and flange bearing 80 in the area of bottom bracket 73. Lead screw 84 terminates within flexible coupling 83 which also connects to motor shaft 85. Motor shaft 85 extends through gear box 79 and is driven by motor 75. A movable mounting block or traveling block 87 threadably engages lead screw 84 and has connected to it the arms 56. As lead screw 84 rotates, mounting block 87 moves up or down along lead screw 84 depending upon the direction of rotation.

Figure 8:
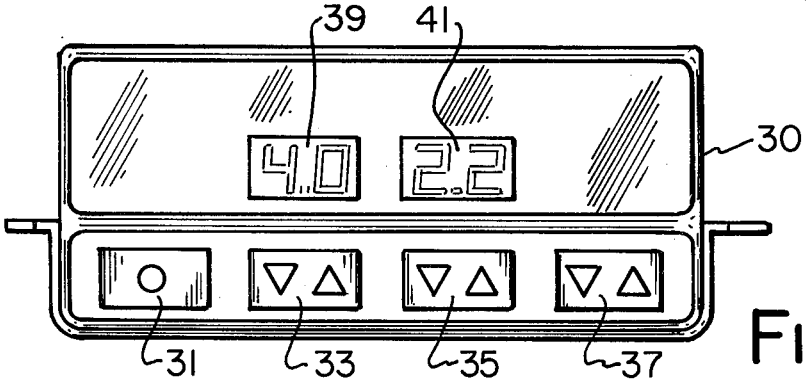
FIG. 8 is a front elevation of the control panel.

The controls, the details of which do not form a part of our invention, for activating the motor 75, 76 and 77 are contained in the control panel 30 located at the front of top surface 18, FIGS. 1 and 8. Control panel 30 includes an on-off switch 31 for the entire unit and three individual control switches 33, 35 and 37 to effect the various movements of the table 10. Specifically, switch 33 activates motor 75 to raise or lower the front table top 18. Switch 35 activates motor 76 and 77 to raise or lower rear table top 16. Switch 37 activates only motor 77 to cause upward or downward tilting of rear table 16. Associated with the raising and lowering switches 33 and 35 are digital readouts 39 and 41, respectively. The readouts 39 and 41 display the actual position of the table top within the range of movement for that table top.

An alternate embodiment of our invention in which the split table top surfaces are manually operable is illustrated in FIGS. 9 through 12. Like parts are identified by the same numeral followed by a prime.

Figure 9:
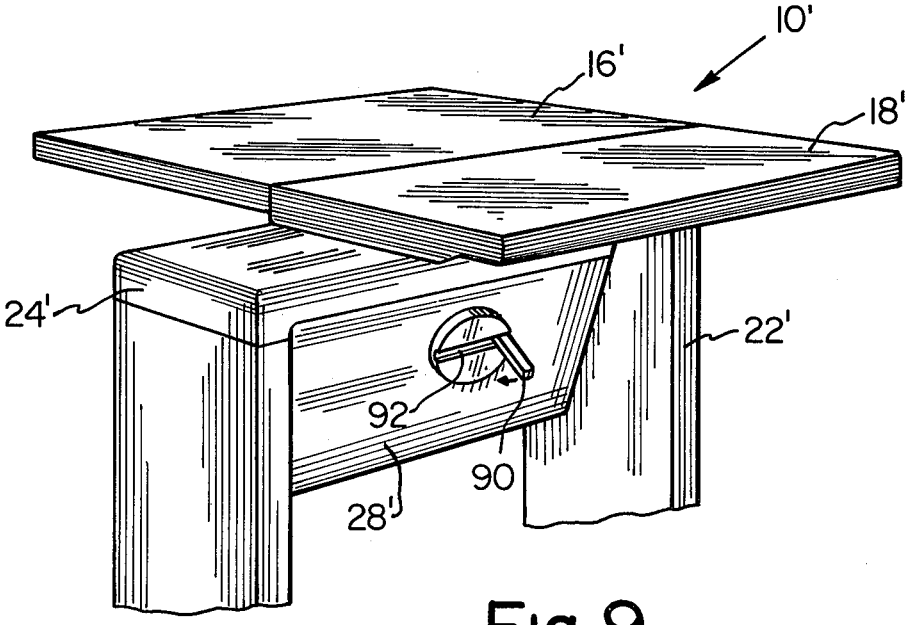
FIG. 9 is a perspective view of the manual form of our adjustable split top table.

The table, generally designated 10', includes a front top 18' and a rear top 16', FIG. 9. Table 10' also includes a top panel 24', side panels 22' and front panel 28' as in the earlier embodiment. Tops 16' and 18' are controlled manually by means of a head crank 90 which is pivotable into a slot 92 contained within front panel 28' so to be substantially flush with panel 28'.

Figure 10:
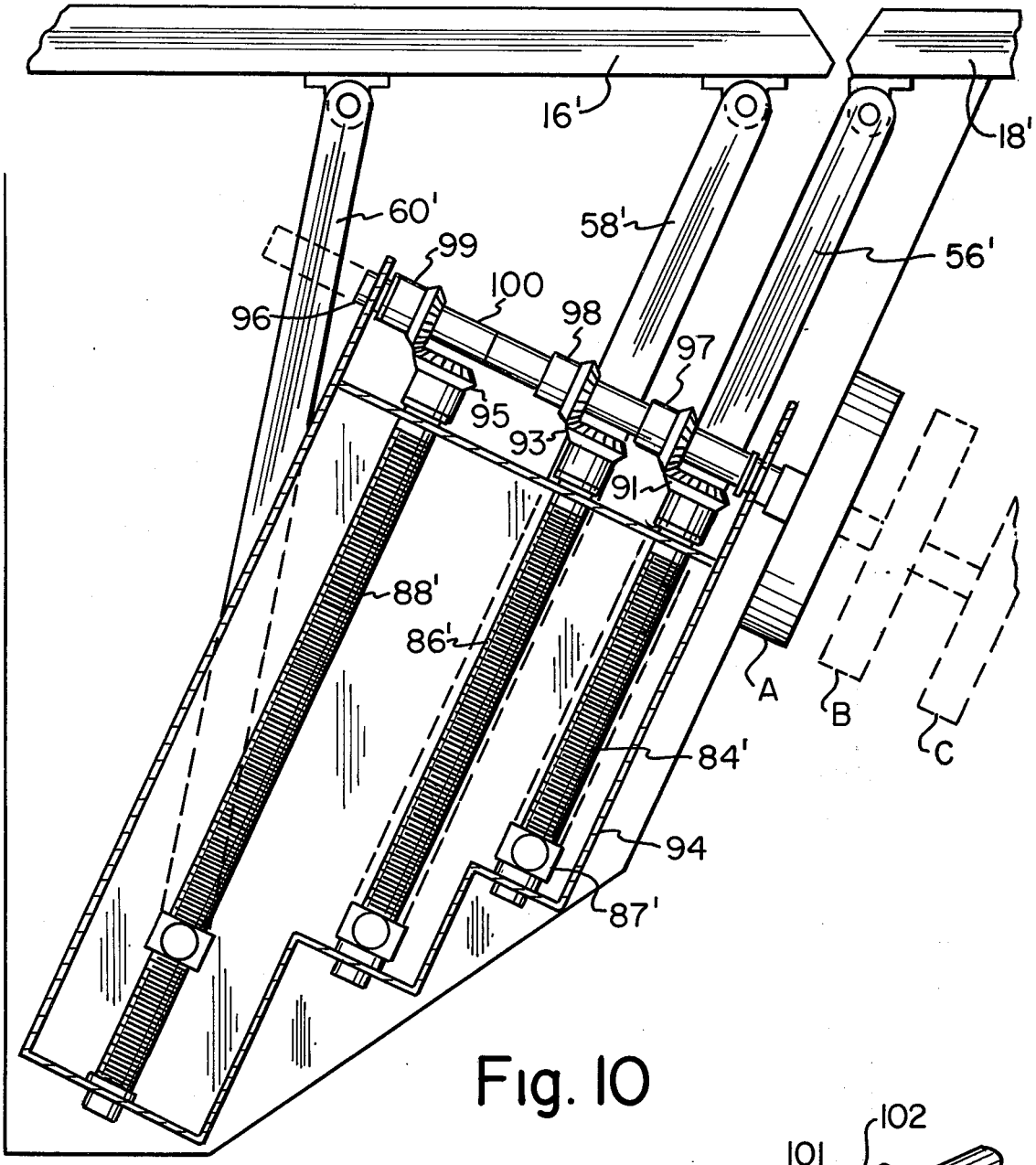
FIG. 10 is a side elevation partly in section showing the operating mechanism of the table of FIG. 9.

The movements of the table tops 16' and 18' are identical with the earlier embodiment but are now controlled by rotation of a main shaft 96 which is associated with lead screws 84', 86' and 88' as will be described hereinafter, FIG. 10. A single housing 94 is mounted to the main frame. Housing 94 contains the lead screws with their movable mounting blocks and their respective arm pairs 56', 58' and 60' as in the earlier embodiment. However, lead screws 84', 86' and 88' are rotatably secured to one end of the housing 94 and terminate at the opposite end in miter gears 91,93 and 95, respectively. Miter gears 91, 93 and 95 are adapted to cooperate with miter gears 97, 98 and 99, respectively which are freely mounted on main shaft 96.

Figure 11:
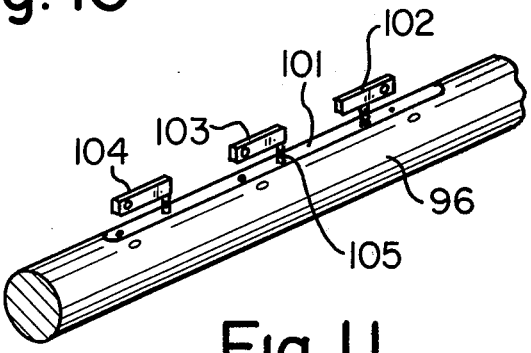
FIG. 11 is a perspective view of a portion of the main shaft of the operating mechanism of FIG. 10.

Shaft 96 includes a continuous slot 101 in which three keys 102, 103 and 104 are spaced and secured, FIG. 11. Each key is spring loaded by means of springs 105 so as to be urged out of slot 101. A series of spacers 100 are positioned between the miter gears 97, 98 and 99 and the spacers 100 retain the keys 102, 103 and 104 within the confines of slot 101 of shaft 96 until the shaft is moved longitudinally into its various operative positions.

Figure 12:
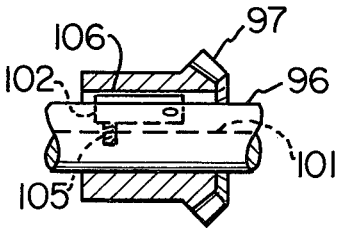
FIG. 12 is an elevational view partly in section showing the engagement of the shaft to the miter gear.

Each miter gear 97, 98 and 99 is keyed to rotate with the shaft and miter gear 97 illustrated in FIG. 12 is exemplary. Miter gear 97 includes an internal slot 106 which is in line with slot 101 and the key 102 secured thereto. Shaft 96 is longitudinally movable with respect to miter gear 97 so that key 102 aligns with slot 106 and is urged thereinto by means of spring 105. When this occurs, miter gear 97 rotates with shaft 96 to translate movement to lead screw 84' and its accompanying traveling block 87' to cause raising or lowering of front top 18' depending on the direction of rotation. Shaft 96 is longitudinally movable between three positions shown by the two dotted positions B and C and the solid position A in FIG. 10. These three positions correspond with the three positions of the earlier embodiment, namely engagement with lead screw 84' alone, engagement with lead screw 88' alone and engagement with lead screws 86' and 88' together for the tilting movement. Once the shaft 96 is manually moved into any of the three positions, turning of the hand crank 90 causes the desired movement.

It will thus be seen that we have provided a table having a split top with each of the top surfaces being adjustable in a raising and lowering position and the rear top being tiltable. This can be accomplished either automatically through electrical controls or manually through a hand crank. In practice we have found that the front section should move up and down a total of four inches, whereas the back section should have the capability of moving up and down through six inches. In addition, the rear top should have the capability of tilting upward 15° and downward 5°. In addition, the front section should have the capability of moving in and out horizontally through approximately six inches.

Our preferred embodiments of the present invention have been illustrated and described and it will be recognized that various modifications may be made without departing from the spirit and scope of the appended claims.

We claim:

1. An adjustable split top table for accommodating word processing equipment and the like comprising:

A. a base support for resting on the floor;

B. a main frame connected to the base support, said main frame including a pair of parallel and spaced members positioned along a longitudinal central axis of the table;

C. a first lead screw operably mounted to said main frame and positioned between said members and inclined forward at an angle on the order of 25° to the vertical;

D. a second lead screw operably mounted to said main frame and between said members and parallel to said first lead screw;

E. a third lead screw pivotally mounted to said main frame and positioned between said members;

F. a traveling block movably secured to each lead screw and a pair of arms upstanding therefrom;

G. table supporting means connected to each pair of arms, said supporting means including a pair of depending legs, each leg positioned in sliding engagement within a support bracket operably connected to the main frame and spaced outward from said spaced members;

H. a front table top mounted to a front bracket, said front bracket slidably mounted on horizontal leg extensions of the depending legs interconnected with the first lead screw;

I. a rear table top mounted to said supporting means interconnected with the second and third lead screws, respectively; and J. drive means for driving said lead screws, said means capable of driving said first lead screw to raise and lower the first table top, of driving said third lead screw to tilt said rear table top and of driving said second and third lead screws to raise and lower said rear table top.

2. The table of claim 1, said drive means including individual motors mounted to individual housings accommodating each of said lead screws.

3. The table of claim 2 including a control box mounted to said front table top, said control box including individual activation means to cause said tilting and raising or lowering of each table top and digital readouts associated with the raising and lowering activation means to display the location of each table top.

4. The table of claim 1, said drive means comprising a manual driven shaft and a single housing accommodating said first, second and third lead screws, each of said lead screws terminating in a miter gear, said shaft including three miter gears spaced therealong, said shaft movable to engage the shaft miter gears and the lead screw miter gears between the positions set forth in paragraph J.

5. The table top of claim 4, said shaft containing an elongated slot having three spring biased keys connected and spaced therein, each of said shaft miter gears having receiving slots for engagement by a respective key to cause rotation of said gear.

6. The table of claim 1, said support brackets for said depending legs associated with the first and second lead screws being rigidly secured to the parallel and spaced members.

7. The table of claim 6, said table supporting means associated with the second lead screw comprising a cross rod extending between said depending legs, said cross rod connected to an underside of said rear table top adjacent the front thereof, said pair of arms connecting to said cross rod midway of said depending legs.

8. The table of claim 7, said table supporting means associated with the third lead screw comprising a cross rod extending between depending legs, said cross rod connected to an underside of said rear table along the midsection thereof, said pair of arms connecting to said underside rearward of the cross rod.

9. An adjustable split top table for accommodating word processing equipment and the like comprising:

A. a base support for resting on the floor;

B. a main frame connected to the base support, said main frame including a pair of parallel and spaced members positioned along a longitudinal central axis of the table;

C. a first lead screw operably mounted to said main frame and positioned between said members and inclined forward to an angle on the order of 25° to the vertical;

D. a second lead screw operably mounted to said main frame and positioned between said members and parallel to said first lead screw;

E. a third lead screw pivotally mounted to said main frame and positioned between said members;

F. a traveling block movably secured to each lead screw and a pair of arms upstanding therefrom;

G. table supporting means connected to each pair of arms, said supporting means including a pair of depending legs, each leg positioned in sliding engagement within a support bracket operably connected to the main frame and spaced outward from said spaced members;

H. a front table top mounted to a front bracket, said front bracket slidably mounted on horizontal leg extensions of the depending legs interconnected with the first lead screw;

I. a rear table top mounted to said supporting means interconnected with the second and third lead screws, respectively;

J. drive means for driving said lead screws, said means capable of driving said first lead screw to raise and lower the first table top, of driving said third lead screw to tilt said rear table top and of driving said second and third lead screws to raise and lower said rear table top, said drive means including individual motors mounted to individual housings accommodating each of said lead screws; and K. each housing including an upper bracket positioned atop said housing, a bottom plate, a supporting bracket connected to the bottom plate and positioned within the housing, a lead screw extending between said bracket and operable within a flange bearing associated with said upper bracket and a thrust bearing and flange bearing associated with the supporting bracket, a flexible coupling connectable between said lead screw and a motor shaft, a gear box and motor connectable to said motor shaft and said bottom plate, said traveling block positioned within the housing for movement by the lead screw and said arms extending through slots in said upper bracket.

* * * * *

UNITED STATES PATENT AND TRADEMARK OFFICE

CERTIFICATE OF CORRECTION

PATENT NO. : 4,440,096

DATED : April 3, 1984

INVENTOR(S) : Thomas E. Rice et al.

It is certified that error appears in the above-identified patent and that said Letters Patent are hereby corrected as shown below:

Column 1 Line 68 "screw" should read --screws--.

Column 2 Line 60 "slop" should read --slope--.

Column 4 Line 46 "head" should read --hand--.

Claim 1 - Column 5 Line 55 After "and" (first occurrence) insert --positioned--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*